US005150162A

United States Patent [19]

Saito

[11] Patent Number: 5,150,162

[45] Date of Patent: Sep. 22, 1992

[54] TONER SUPPLY DEVICE FOR AN IMAGE FORMING APPARATUS

[75] Inventor: Takeshi Saito, Tokyo, Japan

[73] Assignee: Ricoh Company, Ltd., Tokyo, Japan

[21] Appl. No.: 676,446

[22] Filed: Mar. 28, 1991

[30] Foreign Application Priority Data

| | | | |
|---|---|---|---|
| Mar. 28, 1990 | [JP] | Japan | 2-33383[U] |
| Mar. 30, 1990 | [JP] | Japan | 2-34580[U] |
| Apr. 3, 1990 | [JP] | Japan | 2-36397[U] |
| Apr. 6, 1990 | [JP] | Japan | 2-37112[U] |
| Apr. 6, 1990 | [JP] | Japan | 2-37113[U] |
| Apr. 9, 1990 | [JP] | Japan | 2-38237[U] |
| Apr. 17, 1990 | [JP] | Japan | 2-41214[U] |
| Aug. 31, 1990 | [JP] | Japan | 2-92345[U] |

[51] Int. Cl.[5] ..... G03G 15/01

[52] U.S. Cl. ..... 355/260; 355/245; 355/326; 355/327

[58] Field of Search ..... 355/245, 260, 326, 327, 355/251, 253; 222/DIG. 1; 118/656, 653, 657, 658

[56] References Cited

U.S. PATENT DOCUMENTS

| | | | |
|---|---|---|---|
| 4,937,625 | 6/1990 | Kato et al. | 355/245 |
| 4,941,022 | 6/1990 | Ohmura et al. | 355/260 X |
| 4,954,844 | 9/1990 | Morita et al. | 355/260 |
| 4,958,190 | 9/1990 | Ito | 355/245 X |
| 5,036,369 | 7/1991 | Toda et al. | 355/245 X |

OTHER PUBLICATIONS

IBM Technical Disclosure Bulletin, Queener, vol. 15, No. 4 Sep. 1972.

*Primary Examiner*—A. T. Grimley
*Assistant Examiner*—T. A. Dang
*Attorney, Agent, or Firm*—Oblon, Spivak, McClelland, Maier & Neustadt

[57] ABSTRACT

A toner supply device advantageously applicable to a full color copier has a plurality of supply units each being associated with respective one of developing units incorporated in the color copier. The supply units each is selectively engaged with or disengaged from associated one of the developing units by a toner supply path, facilitating the supply of toner and maintenance work.

13 Claims, 13 Drawing Sheets

TONER SUPPLY DEVICE FOR AN IMAGE FORMING APPARATUS

BACKGROUND OF THE INVENTION

The present invention relates to a toner supply device for a copier or similar image forming apparatus and, more particularly, to a toner supply device advantageously applicable to a full color copier.

It is common practice with an image forming apparatus, especially a full color copier, to arrange a plurality of developing units for implementing development in yellow, magenta, cyan and black densely around a photoconductive element. To miniaturize the individual developing units, a toner supply device may be located outside of the developing units to replenish toners as needed, as proposed in the past.

A toner supply device of the type described is disclosed in Japanese Patent Laid-Open Publication No. 178625/1988, for example. Specifically, such a toner supply device is applicable to a copier having a plurality of developing units which are rotatably mounted on a hollow support shaft and movable toward a photoconductive element one at a time in a predetermined position. The toner supply device has a plurality of external hoppers and tubes each communicating respective one of the hoppers to the interior of the hollow support shaft. Toners of different colors each is fed from one of the hoppers to the hollow support shaft by the associated tube. The toner reached the interior of the hollow shaft is supplied to a particular developing unit via a hole which is formed through the wall of the shaft. To increase the space for accommodating the toners of different colors, the hoppers have special shapes and are combined together such that their toner inlet ports are positioned in an array in the front-and-rear or longitudinal direction of the copier body. Further, the hoppers are located at one side and in an upper portion of the copier body and is bodily enclosed by a cover.

Japanese Patent Laid-Open Publication 166565/1986 teaches a toner supply device having a hopper which is rotatable in a toner supply section. To replenish the hopper, the hopper is rotated toward the outside of an apparatus so that a toner supply port thereof may be accessible from the outside. Specifically, an upper portion of the hopper is so tiled as to position the toner inlet port of the hopper in a substantially horizontal position.

The conventional toner supply device of the type using a plurality of external hoppers has various problems left unsolved, as follows. Since the toner inlet ports of the hoppers are sequentially arranged in the longitudinal direction of the apparatus body, attaching toner cartridges to the hoppers located at the rear side is troublesome. Moreover, when toners of different kinds should be supplied at the same time, the cartridges at the front side obstruct the operator's manipulations when it comes to the hoppers located at the rear side, and the operator is apt to mount a wrong toner cartridge. Regarding a full color copier using many different kinds of toners, this not only lowers the efficiency of copying work but also causes toners of different colors to be mixed together. Furthermore, the developing units and their associated external hoppers are communicated by individual tubes, and the hoppers are bodily enclosed by a cover, as stated earlier. Hence, to inspect or repair one supply unit, all the supply units have to be removed from the copier body to disassemble, among others, the connecting portions of the tubes and to connect the individual tubes again to the interior of the hollow support shaft. This shaft in difficult maintenance and disassembly.

On the other hand, the problem with the rotatable hopper scheme is that the volume of the hopper is limited since the upper portion thereof has to be tilted to bring the toner inlet port to a substantially horizontal position. Moreover, to minimize the decrease in volume, the toner supply port has to be positioned close to the apparatus body. As a result, it is likely that the toner is scattered around during the toner supply to contaminate the apparatus.

SUMMARY OF THE INVENTION

It is therefore an object of the present invention to provide a toner supply device which promotes easy and efficient supply of toner.

It is another object of the present invention to provide a toner supply device which enhances easy and efficient maintenance.

It is another object of the present invention to provide a toner supply device which insures a sufficient space for toner supply work while making most of the existing space.

It is another object of the present invention to provide a toner supply device which prevents a toner from solidifying.

It is another object of the present invention to provide a toner supply device which surely prevents a wrong toner cartridge to be mounted and eliminates the mixture of toners of different colors.

A toner supply device for supplying a toner to each of a plurality of developing units incorporated in an image forming apparatus of the present invention comprises a plurality of supply units each being detachably engaged with respective one of the developing units, and toner supply paths for supplying toners from the toner supply units to the associated developing units. The toner supply paths each is selectively connected to or disconnected from the developing unit.

Also, a toner supply device for supplying a toner to each of a plurality of developing units incorporated in an image forming apparatus of the present invention comprises a plurality of supply units each having a toner inlet opening in an upper portion and supplied with a toner from a toner cartridge when the toner cartridge is mated with the toner inlet opening, and a flexible sheet disposed in the toner inlet opening for opening and closing the toner inlet opening. The flexible sheet usually closes the toner inlet opening, closes the toner inlet opening when the toner cartridge is mated with the toner inlet opening by being deformed by the weight of the cartridge, or substantially closes the toner inlet by urging the toner cartridge upward when the weight of the cartridge decreases below a predetermined weight due to the supply of toner.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1A:
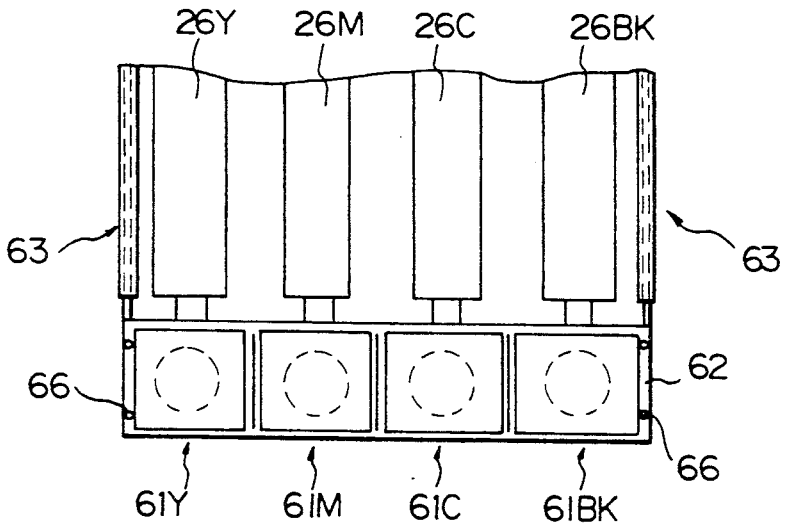
FIGS. 1A and 1B are views showing a color copier to which a toner supply device embodying the present invention is applied.
Figure 1B:
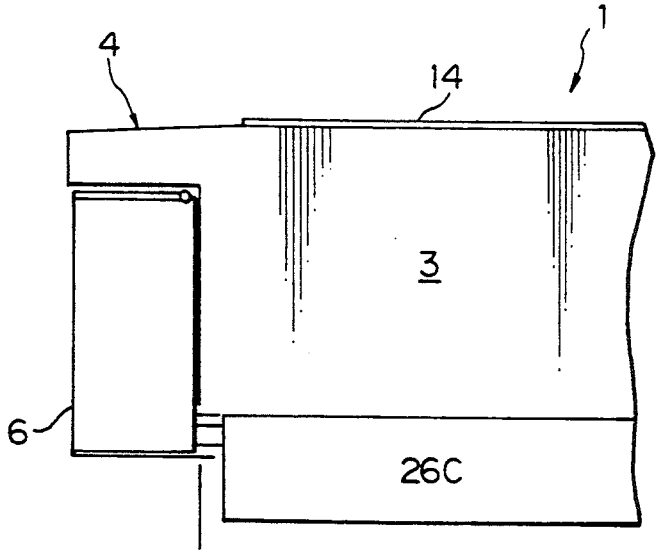
Figure 2A:
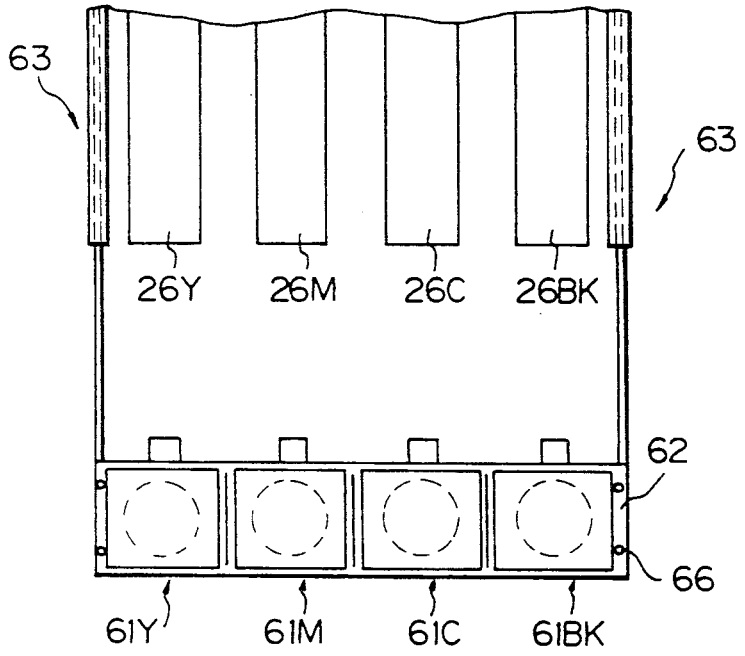
FIGS. 2A and 2B show the toner supply device in a position drawn out from the copier.
Figure 2B:
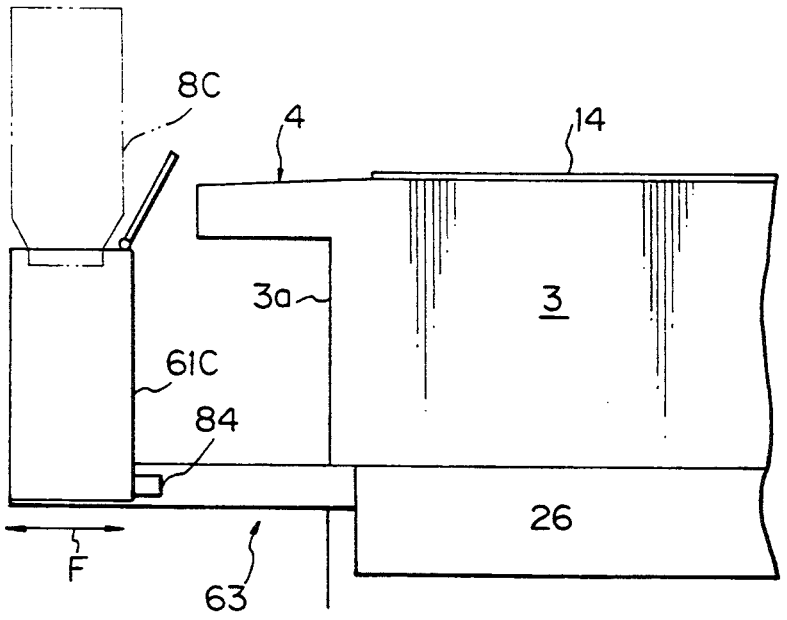
Figure 3:
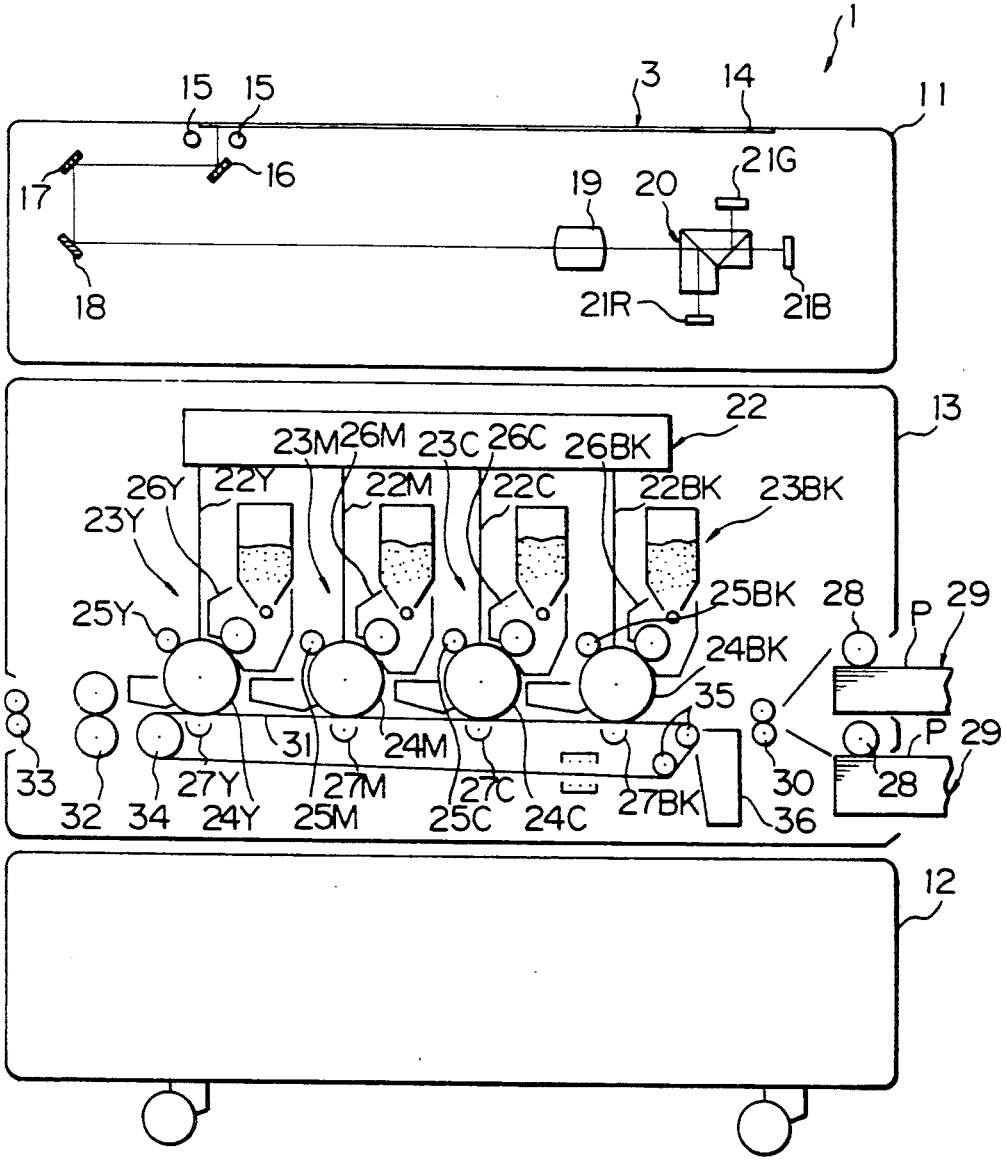
FIG. 3 is a view showing the general construction of the copier body.

Referring to FIGS. 1A, 1B, 2A, 2B and 3, an image forming apparatus implemented as a color copier 1 is shown and has a body 3 for reproducing a document image. A toner supply device 6 embodying the present invention supplies toners of different colors to the copier body 3, as needed. The toner supply device 6 is in turn replenished with toners from toner cartridges 8A, 8M, 8C and 8BK which will be described. As shown in FIG. 3, the apparatus body 3 has a scanner section 11, an image processing section 12 for electrically processing a digital image signal generated by the scanner section 11, and a printer section 13 for printing out an image on a paper sheet in response to the output data of the image processing section 12.

The scanner section 11 has a lamp 15 for scanning a document laid on a glass platen 14 by light. A reflection from the document is routed through mirrors 16, 17 and 18 to reach a lens 19. The lens 19 focuses the incident imagewise light onto a dichroic prism 20. The dichroic prism 20 separates the incident light into, for example, red (R), green (G) and blue (B) color components each having a particular wavelength. These color components R, G and B coming out of prism 20 are incident to CCD (Charge Coupled Device) arrays 21R, 21G and 21B, respectively. The CCD arrays 21R, 21G and 21B each converts the incident light to a digital signal and delivers it to the image processing section 12. In response, the image processing section 12 transforms the digital signal to color data of, for example, yellow (Y), magenta (M), cyan (C) and black (BK) for forming an image. The color data Y, M, C and BK are applied to a writing unit 22 which is included in the printer section 13. Then, the writing unit 22 emits laser beams 22Y, 22M, 22C and 22BK carrying the individual image data to recording units 23Y, 223M, 23C and 23BK, respectively. The recording units 23Y, 23M, 23C and 24BK are positioned at equally spaced locations in the same plane and have an identical construction for electrophotography. The recording unit 23C, for example, has a photoconductive element in the form of a drum 24C, a main charger 25C for uniformly charging the drum 24C, and a developing unit 26C. The uniformly charged surface of the drum 24C is exposed to the laser beam 22C having been modulated by the image data, whereby a latent image representative of the cyan component is electrostatically formed on the drum 24C. The developing unit 26C develops the latent image.

The printer section 13 has paper feeding means constituted by a plurality of paper cassettes 29 and feed rollers 28 each being associated with respective one of the paper cassettes 29. A paper sheet P is fed from any one of the paper cassettes 29 to a register roller 30 by the associated feed roller 28. The register roller 30 drives the paper sheet P toward a transfer belt 312 at such a timing that the leading edge of the paper sheet P meets the leading edge of the developed image, or toner image, at an image transfer position. The transfer belt 31 sequentially transports the paper sheet P to the left in the figure to the successive drums 24BK, 24C, 24M and 24Y each carrying the toner image of particular color thereon. As a result, the toner images are transferred from the drums 24BK to 24Y to the paper sheet P. After the resulted composite toner image has been fixed on the paper sheet P by a fixing roller 32, the paper sheet P is driven out of the copier 1 by a roller 23. The transfer belt 31 is passed over a drive roller 34 and a driven roller 35 under a predetermined tension. A cleaning unit 36 removes the toners which deposit on the transfer belt 31 during the image transfer.

Figure 4:
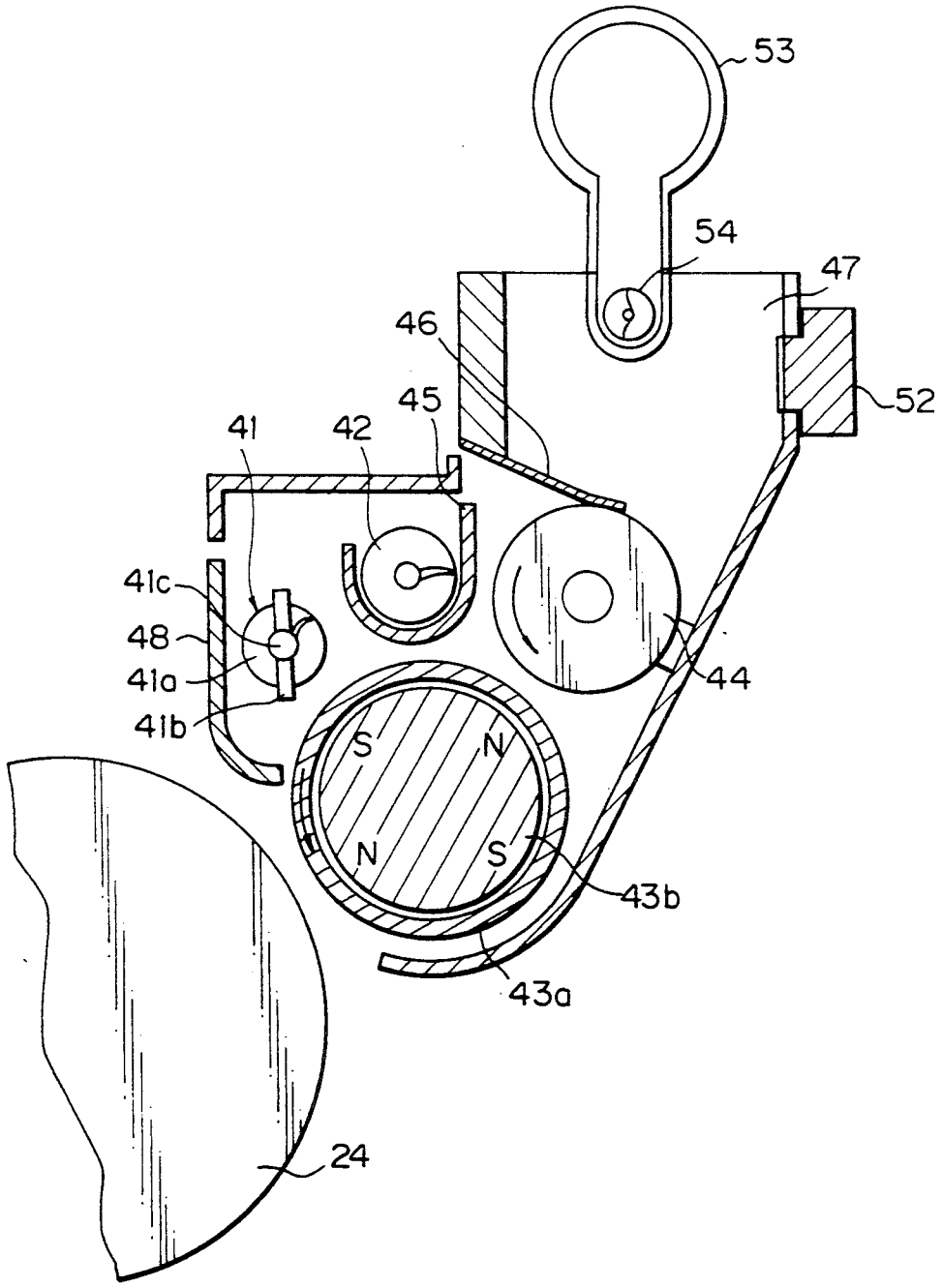
FIG. 4 is a section of a developing unit incorporated in the copier body.
Figure 5:
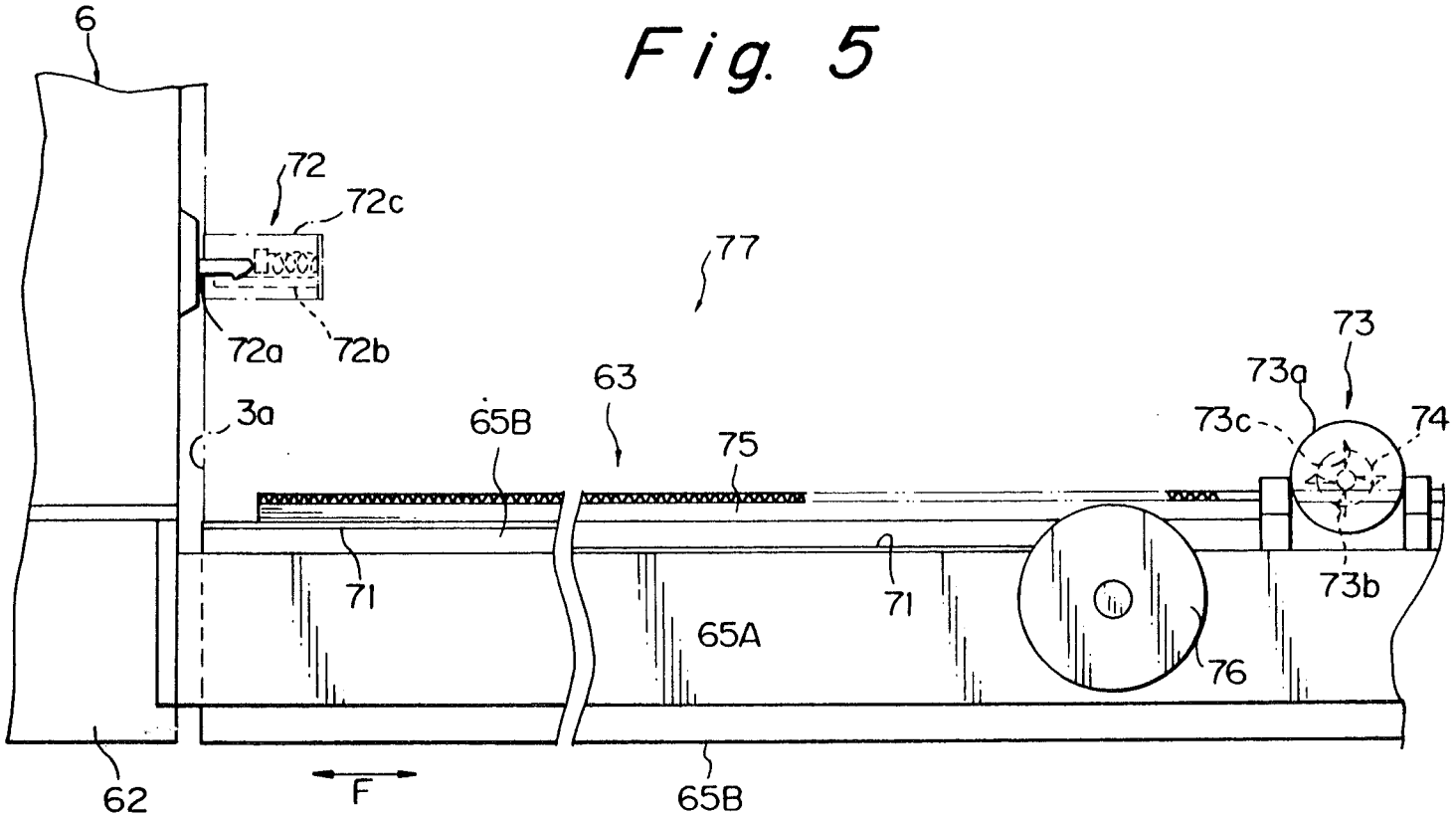
FIG. 5 is a fragmentary side elevation showing moving means included in the embodiment.
Figure 6:
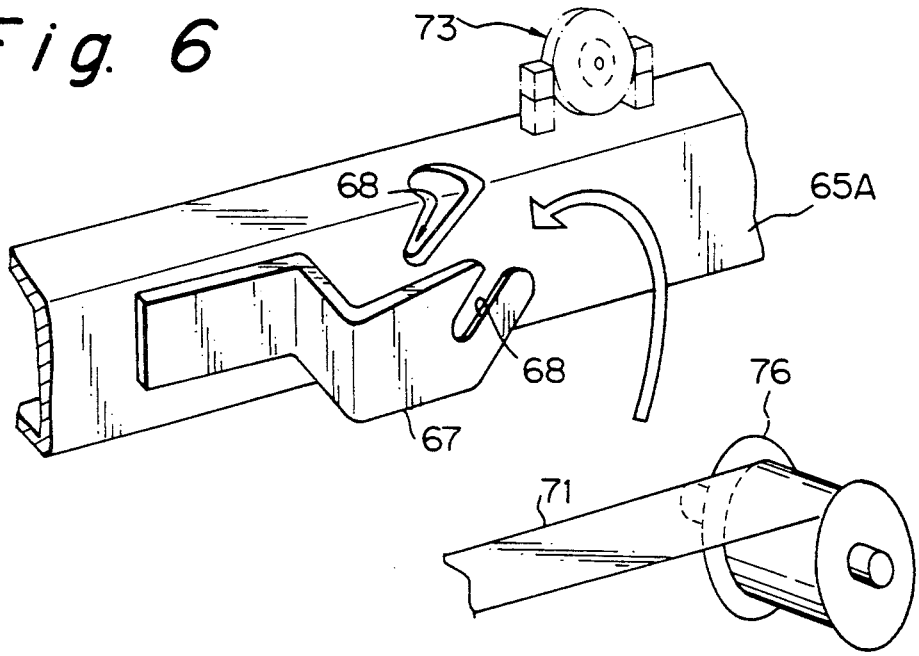
FIG. 6 is a perspective view of a spiral spring and members associated therewith.
Figure 7:
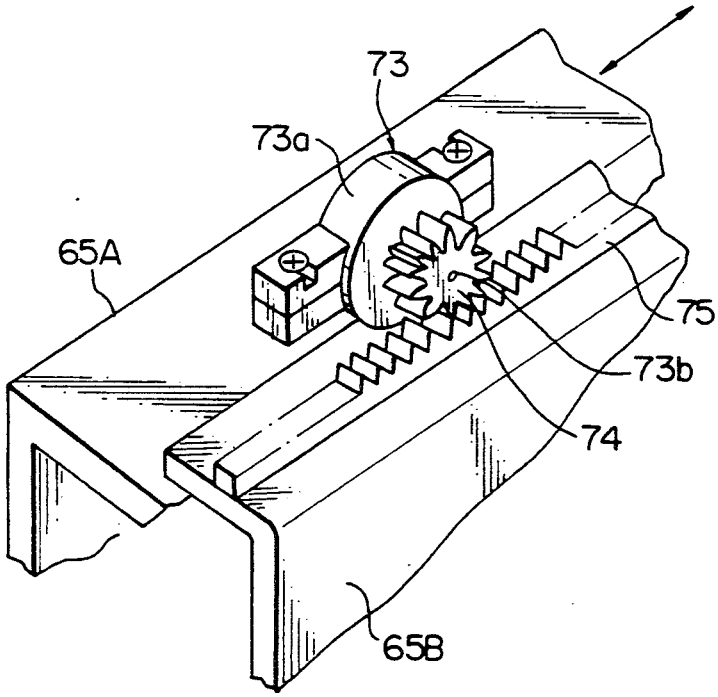
FIG. 7 is a perspective view of a damper member and members associated therewith.

As shown in FIG. 4, the developing units 26BK, 26C, 26M and 26Y (sometimes simply labeled 26) each has a first screw 41, a second screw 42, a developing sleeve 43*a*, a group of stationary magnets 43*b*, a supply roller 44, a screw case 45, a blade 46, a toner tank or toner chamber 47, and a doctor blade 48. A toner, not shown, is stored in the toner tank 47 and deposits on the supply roller 44 by gravity. As the supply roller 44 is rotated, the toner is driven toward the developing sleeve 43*a* through the gap between the blade 46 and the supply roller 44 while being charged to a predetermined polarity. While the developing sleeve 43*a* rotates, the doctor blade 48 regulates the toner to a predetermined thickness before the latter reaches the associated drum 24BK, 24C, 24M or 24Y (sometimes simply labeled 24). In the developing unit 26, the toner collects in a position ahead of the doctor blade 48 and, in this position, the first screw 41 rotates to agitate the toner while moving it toward one end thereof. On the other hand, the toner enters the screw case 45 through a notch formed at the above-mentioned one end side. The second screw 42 in rotation moves such a toner in the opposite direction to the toner being driven by the first screw 41 and thereby discharges it at the other end side. The first screw 41 has a spiral portion 41*a*, an agitating portion 41*b*, and a shaft portion 41*c*. The agitating portion 41*b* agitates the toner in the up-and-down direction. A sensor 52 is responsive to the amount of toner remaining in the toner tank 47. A passage member 53 and a screw 54 cooperate to introduce a toner from the toner supply device into the toner tank 47 in response to the output of the sensor 52.

As shown in FIGS. 1A and 2A, the toner supply device 6 has supply units 61BK, 61C, 61M and 61Y located outside of the developing units 26. The supply units 61BK to 61Y are arranged beneath and in parallel to an operation and display board (operating section) 4 which is provided on the top of the copier body 3 and extends in the right-and-left or lateral direction. The supply units 61BK to 61Y are integrally supported by a movable support frame 62.

Specifically, as shown in FIGS. 5 to 8, the supply units 61 each is removably mounted on the movable frame 62. The frame 62 is mounted on the frame 3*a* of the copier body 3 by a pair of, i.e., left and right side mechanisms or guide members 63 and is movable in a direction indicated by an arrow F (longitudinal direction). The frame 62 and, therefore, all the supply units 61 can be bodily removed from the side mechanisms 63. The slide mechanisms 63 each may be implemented by a pair of rails 65A and 65B which are coupled together in parallel by a plurality of balls, not shown. The rails 65A and 65B are connected to the movable frame 62 and the frame 3*a* of the copier body 3. Positioning pins 66, FIGS. 1A and 1B, and seats, not shown, are provided on the movable rails 65A to position the movable frame 62 easily when the frame 62 is mounted together with the supply units 61. Means for constantly biasing the supply units 61 toward the outside of the toner supply device 6 by a predetermined force is provided between the frame 3*a* of the copier body 3 and the movable frame 62. In the illustrative embodiment, this biasing means is implemented as a spiral spring 71. Also provided between the frames 3*a* and 62 is so-called push-push type latch or similar means 72 for latching the frame 62 or the supply unis 61 to the frame 3*a*. Further provided between the frames 3*a* and 62 are a rotatable damper 73 mounted on the slide mechanism 63, a pinion 74 mounted on the damper 73, and a rack 75 mounted on the stationary rail 65B and held in mesh with the pinion 74.

The spiral spring 71 is affixed to a bobbin 76 at the inner end thereof and tends to resiliently contract about the center of the spiral. The outer end of the spiral spring 71 is anchored to the front end of the frame 3*a* of the copier body 3. The bobbin 76 is removably received in a notch 68 formed in the movable rail 65A and a notch 68 formed in a bracket 67 which is affixed to the rail 65A. As the frame 62 is moved toward the frame 3*a* of the copier body 3, the spiral spring 71 is stretched to accumulate resilient energy. When the latch 72 is unlocked, the spiral spring 71 automatically moves the frame 62 away from the frame 3*a* of the copier body 3 due to the accumulated energy, as shown in FIG. 2B. The latch 72 has a hook 72*a* protruding from the frame 3*a* of the copier body 3, a locking member 72*b* also mounted on the frame 3*a* and facing the hook 72*a* to lock the hook 71*a*, and a case 72*a* accommodating the locking member 72*b*. The latch 72 has a conventional construction, i.e., it locks when pushed once and unlocks when pushed twice.

The damper 73 has a case 73*a* which is filled with, for example, highly viscous silicone oil. When blades 73*b* affixed to the shaft 73*b* of the damper 73 are rotated, the damper 73 exerts viscous resistance. A pinion 74 mounted on the 73*b* is held in mesh with a rack 75 which is mounted on the stationary rail 65B, whereby the movement of the supply units 61 and frame 62 away from the frame 3*a* is regulated. The pinion 74 and rack 75 also serve to prevent the speed of such a movement of the supply units 61 and frame 62 as well as the rail 65A from being changed by the force of the spiral spring 71. While the rack 75 is shown as being located face up, such as a rack may be formed on one side of the stationary rail 65B. This allows the damper 73 and pinion 74 to be arranged in a horizontal position to realize a further compact construction. The frame 62, slide mechanisms 63, positioning pins 66, spiral spring 71, latch 72, damper 73, pinion 74, rack 75, and bobbin 76 constitute moving means 77 for moving the supply units 61BK to 61Y between the two different positions shown in FIGS. 1B and 1A, i.e., a disengaged position and an engaged position. In the position shown in FIG. 1B, the supply units 61BK to 61Y are engaged with the associated developing units 26BK to 26Y beneath the operation and display board 4. In the position shown in FIG. 1A, the supply units 61BK to 61Y are disengaged or spaced apart forwardly from the developing units 26BK to 26Y by a predetermined distance.

Figure 8:
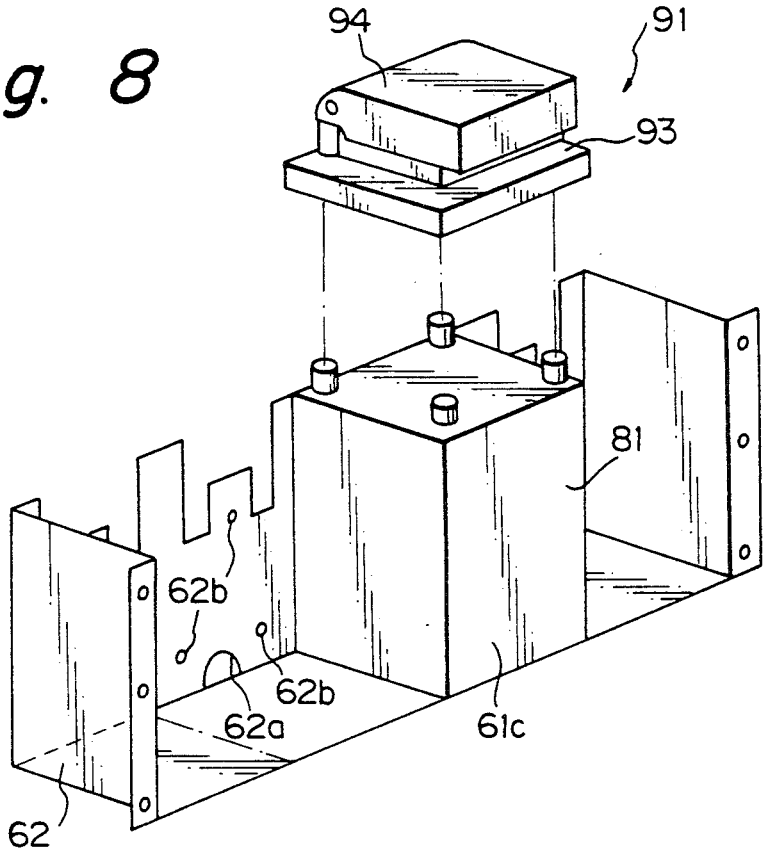
FIG. 8 is a perspective view showing how supply units are amounted on a movable frame.
Figure 9:
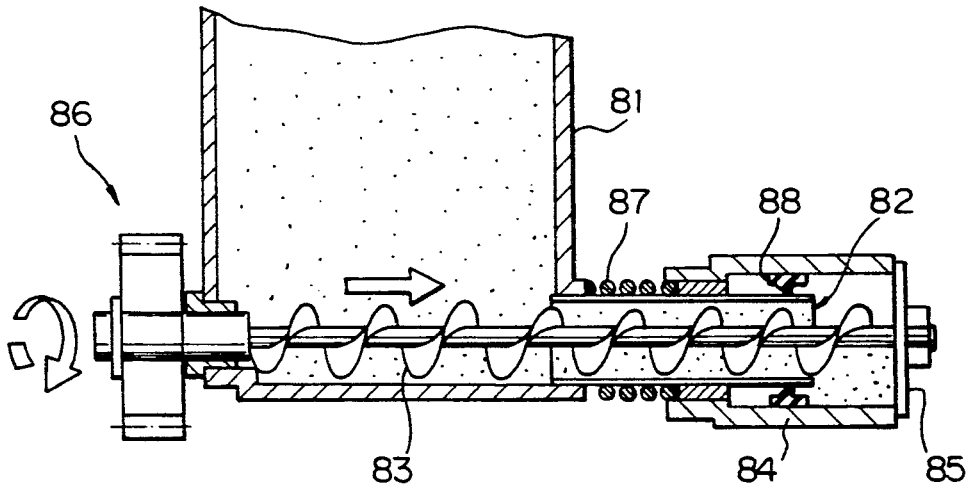
FIG. 9 is a view showing the supply unit disengaged from a developing unit.
Figure 10A:
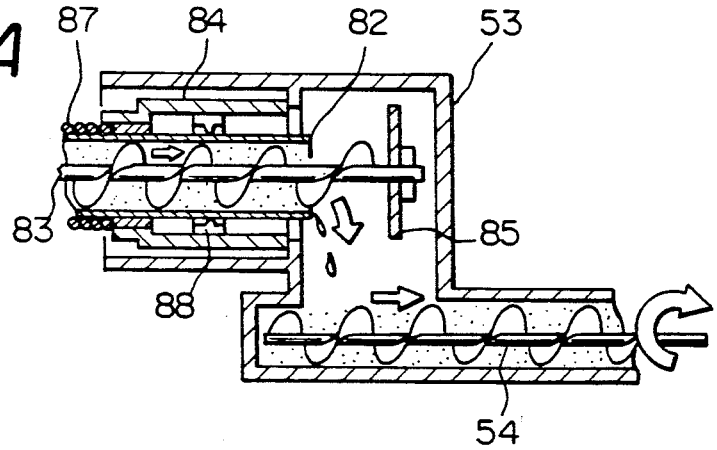
FIGS. 10A to 10C are views indicative of a procedure for connecting the supply unit to the developing unit.
Figure 10B:
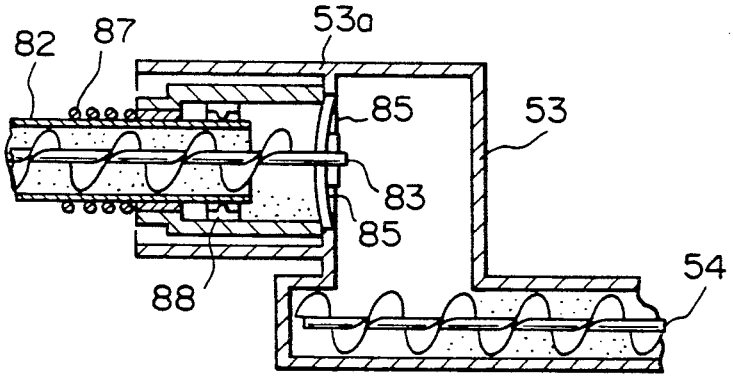
Figure 10C:
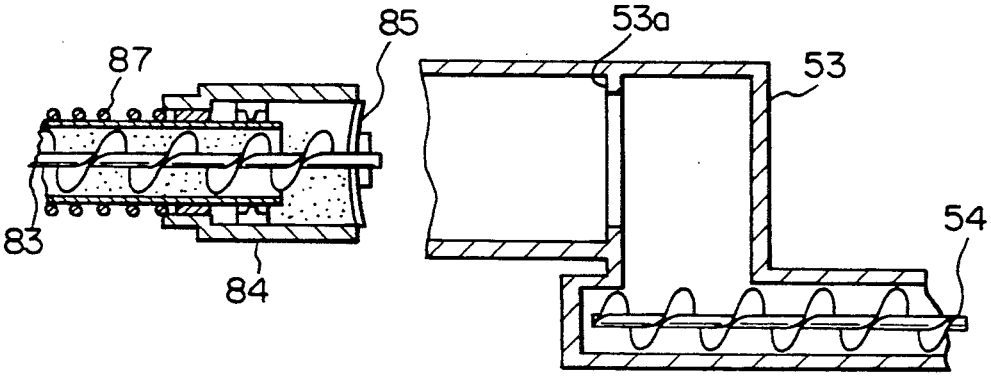

Referring to FIGS. 9 and 10A to 10C, the supply units 61BK to 61Y each has a toner hopper 81, and a tube 82 extending out from the bottom of the toner hopper 81. A screw 83 is disposed in the tube 82 and, when in rotation, conveys a toner in a direction indicated by an arrow in FIG 9. A sleeve 84 is slidably coupled over the tube 82. A packing 85 has a slightly smaller diameter than the sleeve 84 and is mounted on the end of the screw 83 to allow the sleeve 84 to abut thereagainst. Drive means 86 drives the screw 83 and has a motor, worm gear, worm wheel and various gears, although not shown or described specifically. The sleeve 84 is constantly urged against the packing member 85 by a spring 87. A wiper 88 wipes toner particles off the outer periphery of the tube 82. Assume that the supply unit 61 is moved toward the associated developing unit 26 by the moving means 77. Then, the sleeve 84 abuts against a lug 53*a* extending from the inner periphery of the passage member 53 of the developing unit 26 and is thereby spaced apart from the backing 85. As a result, the tube 82 is communicated to the passage member 53 (see FIG. 10A) to set up a toner supply path from the supply unit 61 to the developing unit 26. In FIG. 8, there are shown a hole for inserting the sleeve 84 of the supply unit 61 into the copier body 3, and screw holes 62*b* for fastening the supply units 61 to the movable frame 62.

Figure 11:
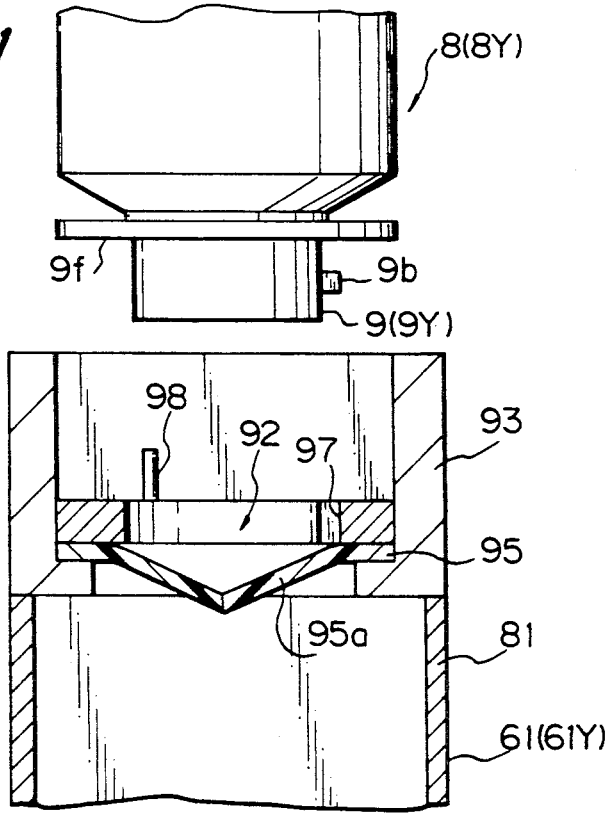
FIG. 11 is a sectional side elevation of the supply unit having a flexible sheet.
Figure 12:
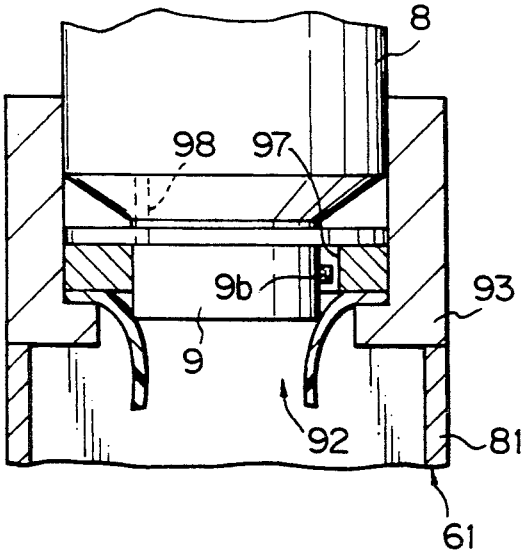
FIG. 12 is view similar to FIG. 11, showing the deformation of the flexible sheet.
Figure 13A:
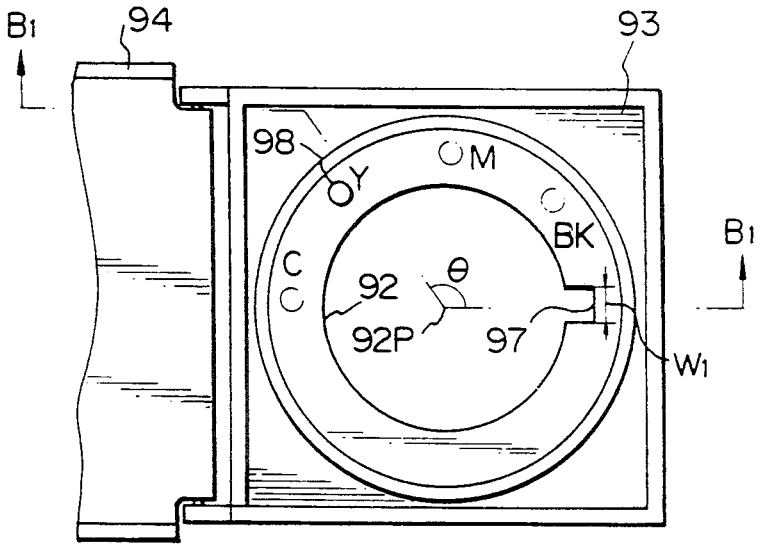
FIG. 13A is a plan view of an inner lid having an opening.
Figure 13B:
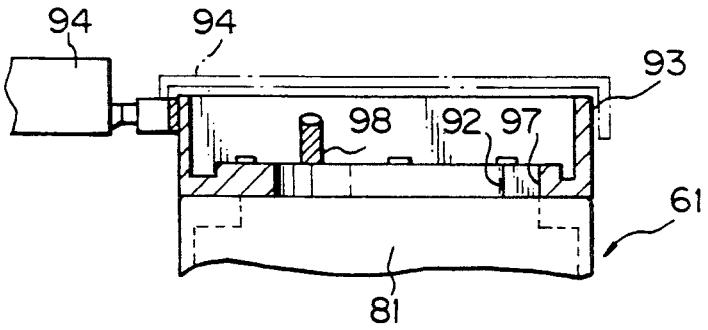
FIG. 13B is a section along line $B_1$—$B_1$ of FIG. 13A.

As shown in FIGS. 8 and 11 to 15B, each supply unit 61 has a mechanism 91 for closing the top opening of the toner hopper 81. The closing mechanism 91 has an inner lid or engaging portion 93 having a substantially circular (or rectangular) opening 92, an outer lid 94, and a circular (or a plurality of rectangles) flexible sheet 95. The opening 92 of the inner lid 93 is adapted to receive a toner cartridge 8Y, 8M, 8C or 8BK (or simply 8). The outer lid 94 is hinged to the inner lid 93 and capable of enclosing the inner lid 93 and is painted in the same color as the toner associated with the supply unit 61. The flexible sheet 95 selectively blocks or unblocks the opening 92 of the inner lid 93. As shown in FIGS. 11 and 12, the flexible sheet 95 usually closes the opening 92 with a plurality of substantially equilateral triangular portions 95*a* thereof contacting each other for with a pair of rectangular portions thereof contacting each other). When the toner cartridge 8 filled with a toner and having a greater weight than a predetermined weight is inserted into the opening 92, the flexible portions 95*a* of the sheet 95 bent downward to unblock the opening 92. As soon as the toner is fed out from the toner cartridge 8 until the weight of the cartridge 8 decreases beyond the predetermined weight, the flexible portions 95*a* are substantially restored to their blocking position while urging the cartridges 8 upward.

As shown in FIGS. 13A to 15B, each supply unit 61 has around the opening 92 thereof at least one projection 98 and at lest one recess 97 which are particular in configuration to the supply unit 61. Therefore, only a particular cartridge 8 having a recess and a projection matching the projection 98 ad recess 97 can enter the opening 92 by deforming the flexible sheet 95. This is successful in preventing a wrong toner cartridge 8 loaded with a toner of unexpected color from being inserted into the opening 92. Specifically, the supply units 61BK, 61Y, 61M and 61C have respectively projections 98 which are labeled C, Y, M and BK in FIG. 13A. More specifically, the angular distance $\theta$ between the projection 98 and the recess 97 with respect to the center 92P of the opening 92 is different from one toner cartridge 8 to another. In the illustrative embodiment, the angle $\theta$ is selected to be 135 degrees for the supply unit 61, 180 degrees for the supply unit 61C, 90 degrees for the supply unit 61M, and 45 degrees for the supply unit 61BK.

In this embodiment, the recess 97 is located adjacent to the front end of the copier 1. In the position shown in FIG. 2B, assume that the projection 98 and recess 97 of the supply unit 61 have matched a notch 9*a* and a lug 9*b* formed in a openable lid 9Y, 9M, 9C or 9BK of a cartridge 8 of particular color. Then, the lid 9 of the toner cartridge 8 is inserted into the opening 92 until the recess 97 and projection 9*b* and the projection 98 and notch 9*a* fully mate with each other. In this condition, the cartridge 8 and the lid 9 can be rotated relative to each other. As the cartridge 8 is rotated 180 degrees, a substantially semicircular opening 8*b* formed in the toner cartridge 8 and an opening 9*c* formed in the lid 9 are aligned with each other with the result that the toner is fed from the cartridge 8 into the supply unit 61.

Figure 14A:
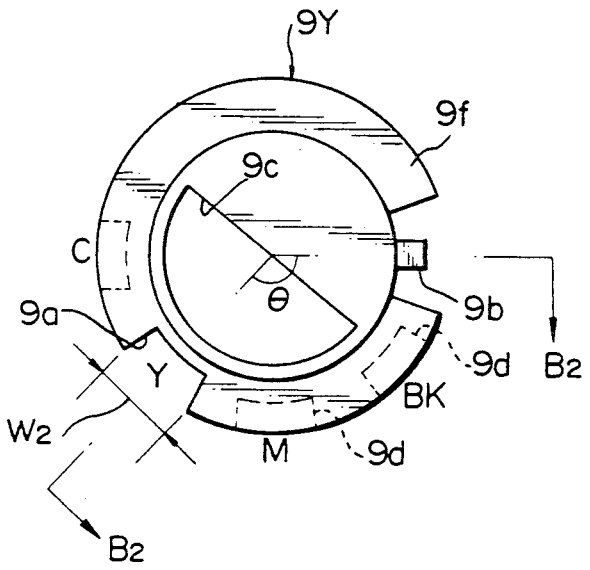
FIG. 14A is a bottom view of an openable lid of a toner cartridge.
Figure 14B:
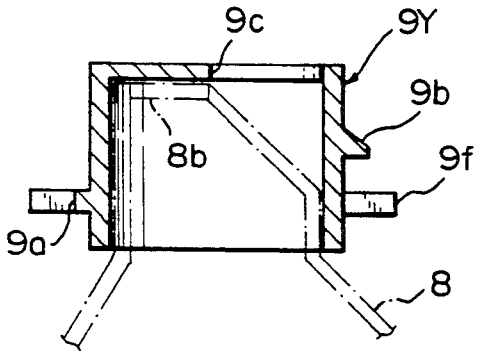
FIG. 14B is a section along line $B_2$—$B_2$ of FIG. 14A.
Figure 15A:
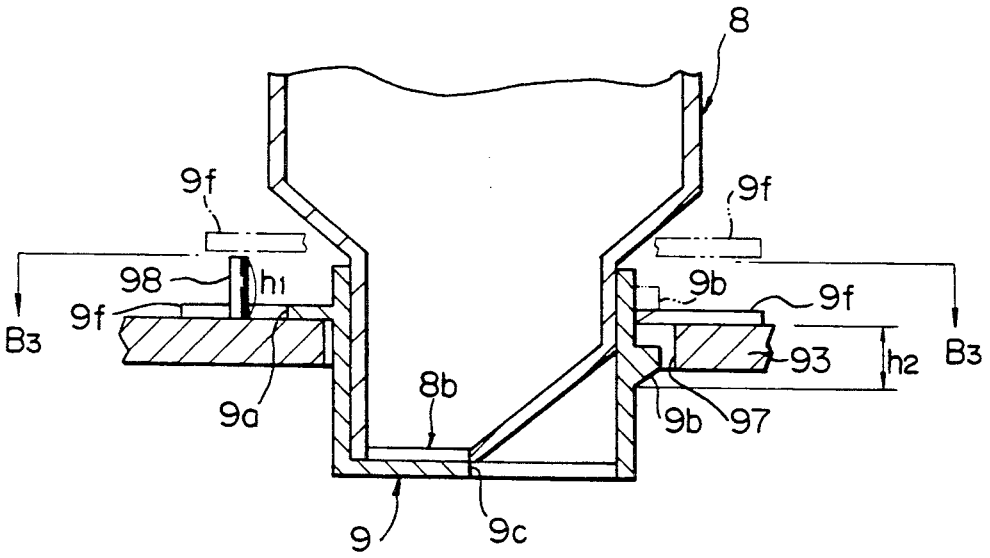
FIG. 15A is a section showing a condition wherein the toner cartridge is inserted in the opening of the flexible sheet.
Figure 15B:
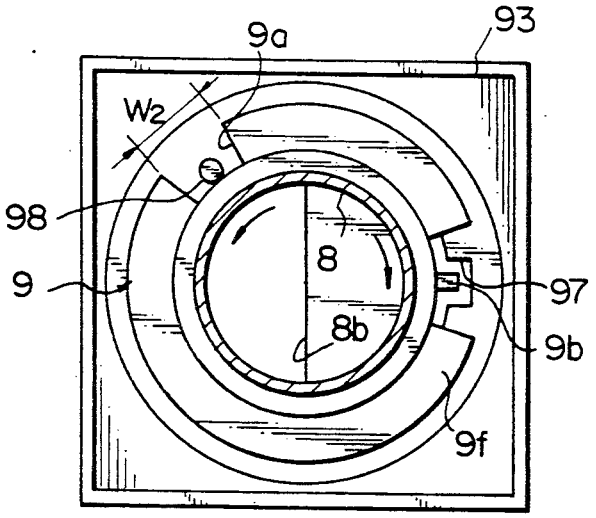
FIG. 15B is a top view along line $B_3$—$B_3$ of FIG. 15A.

As shown in FIG. 15A, the projection 98 has a height h1 greater than the distance h2 between the projection 9*b* of the lid 9 and the underside of a flange 9*f*. Therefore, when the flange 9*f* interferes with the projection 98 to prevent the projection 9*b* from entering the opening 92, the opening 8*b* of such a toner cartridge 8 cannot open the opening 8*b*. As shown in FIG. 14A, the lid 9 of the toner cartridge 8 may be formed with a plurality of recesses 9*d* each being identical in configuration with the notch 9*a* beforehand at the time of molding, Then, particular one of the recesses 9*d* will be bent and removed from the lid 9 to form the recess 9*a* afterwards. This allows all the toner cartridges 8 to have identical lids 9 at the production stage and thereby cut down the cost. The recess 97 of the inner lid 83 has a width $W_1$ smaller than the width $W_2$ of the notch 9*a* of the lid 9, so that the toner cartridge 8 is positioned by using the recess 97 as a reference.

Figure 16A:
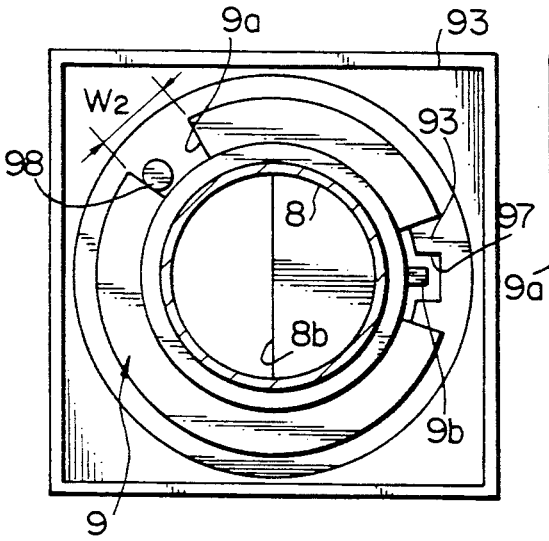
FIGS. 16A to 16C are view showing another specific configuration of a projection and a recess around the opening of the flexible sheet and those of the openable lid.
Figure 16B:
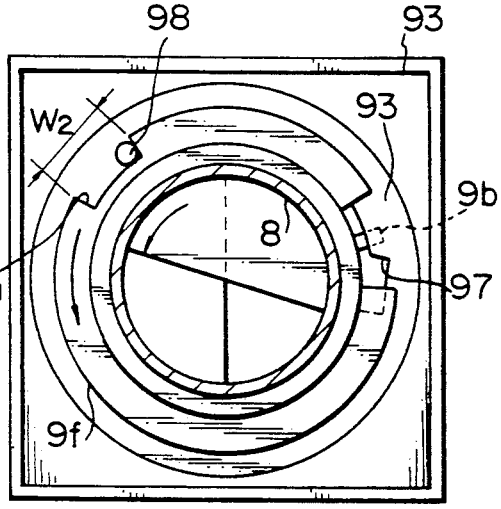
Figure 16C:
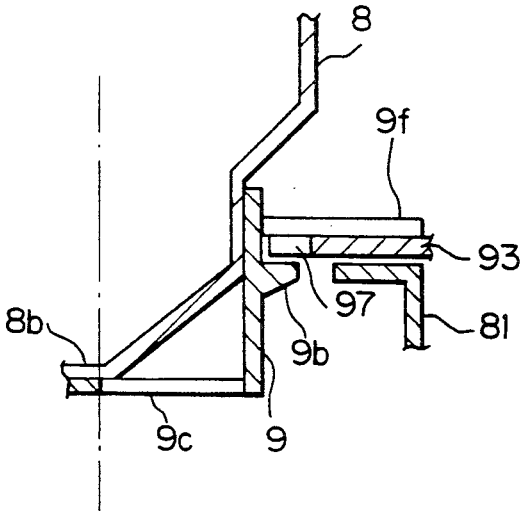

FIGS. 16A to 16C show another specific configuration of the opening 92. As shown, at least one of opposite side walls of the recess 97 is reduced in dimension so that, when the toner cartridge 8 is inserted in the opening 92 and then rotated in the opening direction, the projection 9*b* of the lid 9 is released from the recess 97. Then, the opening 8*b* is opened with the lid 9 abutting against the projection 98 and, therefore, the toner cartridge 8 is prevented from being removed while the toner supply is under way. More specifically, assume that the projection 98 and recess 97 match the notch 9*a* and projection 9*b* of the lid 9, and that the toner cartridge 8 with such a lid 9 is inserted into the opening 92 and the rotated to open the opening 8*b*. In this condition, while the toner is successfully fed from the toner cartridge 8 to the supply unit 61, the toner cartridge 8 is prevented from being accidentally removed from the supply unit 61. Of course, three or more projection and recess combinations may be used.

In operation, the image processing section 12 processes a digital image signal generated by the scanner section 11, as stated earlier. The printer 13 prints out an image on a paper sheet P in response to the resultant image data of different colors fed thereto from the image processing section 12. During the printing operation, the toner supply units 61 are operatively engaged with their associated developing units 26. Assume that the amount of toner remaining in any one of the developing units 26 is short as determined by the sensor 52. Then, the drive means 86 is activated in response to the output of the sensor 52 to feed a toner from the associated supply unit 61 to the toner tank 47 of the developing unit 26. Hence, so long as a predetermined amount of toner exists in the toner hopper 81 of the supply unit 61, it is adequately supplied to the developing unit 26. As the toner in the supply unit 61 becomes shot, a toner sensor, not shown, located in a lower portion of the toner hopper 81 senses the shortage and causes the operation and display board 4 to display a message for alerting the operator to such an occurrence.

Then, the operator opens a front panel or door provided on the front end of the frame 60 of the copier 1 and then lightly touches the movable frame 62 or the supply unit 61 to release the frame 62 from the latch 72. Then, the supply units 61BK to 61Y are automatically forced out by the spiral spring 71 having accumulated resilient energy therein. The diameter 73 allows the supply units 61BK to 61Y to move stably and slowly to the previously stated disengaged position. The packing 85 and the sleeve 84 again abut against each other to fully block the toner supply path from the supply unit 61 to the developing unit 26. Therefore, the supply units 61 and slide mechanisms 63 are free from shocks or impacts while the toner is surely prevented from being scattered around. In addition, such a configuration grades up the copier 1.

In the position shown in FIG. 2B, a particular toner cartridge 8 is put on the supply unit 61 which is short of toner. It is noteworthy that the supply unit 61 is sufficiently spaced apart from the frame 60 of the copier 1 and, therefore, insures a space wide enough to facilitate the supply of toner. Since the toner supply units 61 have supply openings 61*a* at the top thereof which are arranged in the right-and-left direction, even a plurality of supply units 61 may be replenished easily at the same time.

To supply a toner in the disengaged position of FIG. 2B, the painted outer lid 94 of the closing mechanism 91 is raised to uncover the opening 92 of the inner lid 93, and then the toner cartridge 8 is fitted in the opening 92. Assume that the toner cartridge 8 matches the supply unit 61, i.e., the angle $\theta$ between the projection 98 and the recess 97 of the inner lid 93 and the angle between the notch 9*a* and the projection 9*b* of the lid 9 are the same. Then, the lid 9 can be inserted into the opening 92 deep enough to deform the flexible sheet 95. Then, the openable lid 95 deforms the flexible sheet 95 to open the opening 92. At the inner cartridge 8 is rotated in a predetermined direction, it rotates only in a predetermined range of play since the notch 9*a* and projection 9*b* thereof abut against the inner lid 93. As a result, the body of the toner cartridge 8 and the openable lid 9 rotate relative to each other to unblock the opening 8*b*, causing the toner to be fed into the toner hopper 81 by gravity.

When a toner cartridge 8 filled with a toner of unexpected color or a toner cartridge having different specifications is loaded on the supply unit 61, it cannot open the opening 92 since the projection and notch thereof will not mate with the recess 97 and projection 98 of the supply unit 71. Such a configuration prevents a toner of one color to be mixed with a toner of another color or prevents a toner from being scattered around even when a wrong toner cartridge whose appearance is similar to correct one is accidentally mounted on the supply unit 61.

As the toner is sequentially fed from the toner cartridge 8 to the toner hopper 81, the weight of the toner cartridge 8 decreases. On the decrease of the weight below a predetermined weight, the flexible portions 95*a* of the sheet 95 elastically urge the cartridge 8 upward by a predetermined height and reduces the area of the opening 92. This allows the operator to easily see that the toner supply is almost completed. At this instant, the notch 9*a* and projection 9*b* of the lid 9 are still mated with the lug 98 and recess 97 of the inner lid 93. Hence, rotating the toner cartridge 8 in the opposite direction to the above-stated direction causes the opening 8*b* to close. Subsequently, the toner cartridge 8 is removed from the projection 9*b*. As a result, the flexible sheet 95 is elastically restored to close the opening 92. In this manner, the opening 92 is automatically opened or closed when the toner cartridge 8 is mounted or dismounted. This remarkably enhances efficient toner supply operations and eliminates the scattering of toner in the event when the toner cartridge 8 is mounted and dismounted.

On the completion of toner supply, the outer lid 94 is closed to cover the opening 92. Then, the supply unit 61 or the movable frame 62 is pushed toward the copier body 3 and then locked to the frame 3*a* of the copier body by the latch 72. At this instant, the spiral spring 71 exerts an adequate degree of resistance to the movement of the supply units 61 to the engaged position while accumulating resilient energy. At the same time, the damper 73 regulates the moving speed of the supply units 61. This not only enhances smooth operations but also frees the supply units 61 and developing units 26 from impacts to thereby prevent the toner in the supply units 61 from solidifying.

Thereafter, the front panel or door of the frame 60 of the copier 1 is closed to complete the toner supplying procedure.

For the maintenance or the assembly of any one of the supply units 61, developing units and other units of the copier 1, the supply units 61 will be moved and/or dismounted in the above-described manner to insure a sufficient working space.

In summary, in the illustrative embodiment, the supply units 61 each is detachably engaged with associated one of the developing units 26 so as to selectively establish or interrupt the toner supply path from the supply unit 61 to the developing unit 26. To interrupt the toner supply path, the supply unit 61 is fully isolated from the developing unit 26 to facilitate the supply of toner, assembly and maintenance while insuring a sufficient space for such work.

In the engaged position, the plurality of supply units 61 are arranged in parallel to and beneath the operation and display board 4 and integrally supported by the movable frame 62. In such a position, the supply units 61 are locked to the frame 3*a* of the copier body 3 by the latch 72. When the supply units 61 are released from the latch 72, they are automatically moved from the engaged position to the disengaged position ahead of the board 4 by the spiral spring 71 while being regulated in speed by the damper 73. Such an automatic and smooth movement of the supply units 61 promotes easy and efficient toner supply. In addition, when the supply units 61 are retracted toward the engaged position, the spiral spring 71 and damper 73 exert an adequate degree of resistance to free the supply units from impacts. This is successful in preventing the toners from solidifying in the supply units 61 and grading up the color copier.

Various modifications will become possible for those skilled in the art after receiving the teachings of the present disclosure without departing from the scope thereof.

What is claimed is:

1. A toner supply device for supplying a toner to each of a plurality of developing units incorporated in an image forming apparatus, comprising:

a plurality of toner supply units each being detachably engaged with respective one of said plurality of developing units; and toner supply path means for supplying a toner from each of said plurality of toner supply units to associated one of said plurality of developing units;

said toner supply path means being selectively connected to or disconnected from said developing units;

said device further comprising support means for supporting said plurality of toner supply units integrally beneath and in parallel to a operating section of said image forming apparatus, said operating section being positioned in a front portion of said image forming apparatus and extending in a lateral direction of said image forming apparatus.

2. A device as claimed in claim 1 further comprising moving means for moving said plurality of toner supply units between an engaged position below said operating section and where said toner supply units engage with said developing units, and a disengaged position spaced apart from said developing units by a predetermined distance.

3. A device as claimed in claim 2, wherein said support means comprises a movable support frame, said plurality of toner supply units being removably mounted on said movable support frame independently of each other.

4. A device as claimed in claim 3, wherein a toner is fed to each of said plurality of supply units in said disengaged position.

5. A device as claimed in claim 4, wherein said plurality of toner supply units each is removable from said support frame in said disengaged position.

6. A device as claimed in claim 5, further comprising locking means for locking said plurality of toner supply units to a frame of said image forming apparatus.

7. A device as claimed in claim 6, wherein said moving means comprises:

guide members mounted on said body of said image forming apparatus for guiding said movable support frame between said engaged position and said disengaged position; and a spring member extending between said movable support frame and said frame of said image forming apparatus for resiliently causing said toner supply units to move from said engaged portion to said disengaged position.

8. A device as claimed in claim 7, further comprising a damper member provided between said movable support frame and said frame of said image forming apparatus for regulating a speed at which said supply units are moved from said engaged position to said disengaged position.

9. A device as claimed in claim 8, wherein said damper member comprises a rotatable damper mounted on one of said movable support frame and said frame of said image forming apparatus, a pinion mounted on said damper member meshing with rack mounted on the other of said movable frame and said frame of said image forming apparatus.

10. A toner supply device for supplying a toner to each of a plurality of developing units incorporated in an image forming apparatus, comprising:

a plurality of toner supply units each having a toner inlet opening in an upper portion and supplied with a toner from a toner cartridge having a predetermined weight when said toner cartridge is mated with said toner inlet opening; and a flexible sheet disposed in said toner inlet opening for opening and closing said toner inlet opening;

said flexible sheet usually closing said toner inlet opening and permitting said toner inlet opening to be opened when said toner cartridge is mated with said toner inlet opening by being deformed by a weight of said toner cartridge which is greater than said predetermined weight, or substantially closing said toner inlet opening by urging said toner cartridge upward when the weight of said toner cartridge decreases below said predetermined weight due to a supply of toner to said toner supply units.

11. A device as claimed in claim 10, wherein said plurality of toner supply units each comprises an engaging portion located around said toner inlet opening and comprising at least one projection and at least one recess which are particular in configuration to a toner supply unit of said plurality of toner supply units, said flexible sheet having said toner inlet opening being deformed only by a toner cartridge having a recess and a projecting matching said engaging portion.

12. A device as claimed in claim 11, wherein said toner cartridge has said recess and said projection in an openable lid thereof.

13. A device as claimed in claim 12, wherein when said recess and said projection of said openable lid of said toner cartridge match said projection and said recess of said engaging portion of said toner supply unit, said toner cartridge is rotated to open said toner cartridge and unremovably retained by said supply unit.

* * * * *